US007841494B2

(12) United States Patent
Batinkoff et al.

(10) Patent No.: US 7,841,494 B2
(45) Date of Patent: Nov. 30, 2010

(54) PUMP DISPENSER

(75) Inventors: Randall Batinkoff, 2812 6th St., Santa Monica, CA (US) 90405; William Andrew Brandt, Castaic, CA (US)

(73) Assignee: Randall Batinkoff, Santa Monica, CA (US)

( * ) Notice: Subject to any disclaimer, the term of this patent is extended or adjusted under 35 U.S.C. 154(b) by 531 days.

(21) Appl. No.: 11/724,701

(22) Filed: Mar. 16, 2007

(65) Prior Publication Data

US 2008/0223879 A1 Sep. 18, 2008

(51) Int. Cl.
*B05B 11/06* (2006.01)

(52) U.S. Cl. ..... 222/633; 222/207; 222/209

(58) Field of Classification Search ..... 222/207, 222/209, 631–633; 239/338
See application file for complete search history.

(56) References Cited

U.S. PATENT DOCUMENTS

| | | | | | |
|---|---|---|---|---|---|
| 277,900 | A * | 5/1883 | Hayes | 222/633 |
| 1,142,636 | A * | 6/1915 | Singer | 222/633 |
| 1,776,489 | A | 9/1930 | Cobb | |
| 2,098,160 | A * | 11/1937 | Perritt | 222/209 |
| 2,202,079 | A * | 5/1940 | Ayres | 222/633 |
| 2,223,256 | A * | 11/1940 | Kross | 222/400.8 |
| 2,358,329 | A * | 9/1944 | Houghton | 222/633 |
| 2,421,183 | A * | 5/1947 | Cakebread | 222/631 |
| 6,168,781 | B1 | 1/2001 | Ukaji et al. | |
| 6,616,067 | B1 * | 9/2003 | Hunter | 239/338 |
| 7,140,522 | B2 * | 11/2006 | Kress | 222/633 |

FOREIGN PATENT DOCUMENTS

| | | |
|---|---|---|
| WO | PCT/EP97/00205 | 7/1997 |
| WO | PCT/US00/14756 | 5/2000 |

* cited by examiner

*Primary Examiner*—Kevin P Shaver
*Assistant Examiner*—Andrew Bainbridge
(74) *Attorney, Agent, or Firm*—Ostrager Chong Flaherty & Broitman P.C.

(57) ABSTRACT

The invention is a pump cap that is designed to seat on top of a receptacle, which in at least one example is filled with powder or hair fibers. The cap is fitted on top with a deformable dome with an empty chamber of air within it. The cap has an air inlet with a check valve that then opens into a wide flared opening into the dome's empty chamber. The air in the dome is pushed past a check valve and down a long passageway into the receptacle to aggressively disturb the powder or hair fibers within the receptacle. The disturbed hair fibers or powder then exits the cap through a third passage with a flared opening that is flush with the bottom of the cap that then exits out the side of the cap.

11 Claims, 2 Drawing Sheets

PUMP DISPENSER

FIELD OF THE INVENTION

The present invention relates to a pumping device for dispensing a media. More specifically the present invention relates to a manually activated pump dispenser having a pump cap which is adapted to couple to a receptacle which pump dispenser is suitable for dispensing powder or fiber onto a scalp or other parts of the body and is easily manipulated by a single hand of the user.

BACKGROUND OF THE INVENTION

A variety of powder dispensers have heretofore been used or proposed for use for dispensing solid materials of a variety of compositions including, talcum powder, deodorants and the like.

Powder dispensers of the squeeze-bottle type have been used. These types of dispensers comprise a receptacle of a flexible material such as plastic to provide side walls that can readily be deflected inwardly by the fingers to effect a manual discharge of the powder contents in a series of intermittent bursts. Typical of prior art powder dispensers are those as described in U.S. Pat. Nos. 2,450,205, 4,007,858 and 4,307,823.

Powder dispensers in which a squeeze bulb is used to deliver air to a powder receptacle at a point well down in the powder supply and a discharge tube delivers powder from an adjacent air delivery point up to discharge are described in U.S. Pat. Nos. 2,202,079, and 2,358,329. A continuing problem associated with such squeeze-bottle type powder dispensers has been the inability to attain substantially uniformly dispersed air-powder discharge streams having a well defined discharge pattern.

U.S. Pat. No. 6,168,781 discloses a dispenser for spraying pseudo hair increasing material comprising a first receptacle for storing therein pseudo hair increasing material in a form of powder or short fabrics, and a second receptacle for storing therein propellant gas.

Disadvantages associated with prior art powder dispensers include complicated design which makes it expensive to manufacture and the requirement of the use of both hands in order to operate the dispenser.

SUMMARY OF THE INVENTION

The disadvantages of the prior art are overcome by the present invention which provides an improved pump cap for dispersing a media.

Thus, an object of the present invention is to provide a pump cap that is simple and inexpensive to manufacture and to assemble.

Another object of the present invention is to provide such a pump cap that is easily manipulated by a single hand of the user.

A further object is to provide a pump cap which provides an improved dispersion of the media providing a discharge that can be accurately directed at objects, such as the head or body or a person.

Another object is to provide a pump cap consisting of a bulb and a dispenser.

The present invention further provides a pump cap, wherein said bulb is wedged into the dispenser through grooves that are located on the side of the upper end of the dispenser thereby enabling the bulb to sit on top of the dispenser and providing an airtight seal between the dispenser and the bulb.

Yet another object is to provide a pump dispenser consisting of the pump cap of the present invention and a receptacle.

Another object of the present invention provides a pump dispenser which is suitable for dispensing a media.

A further object of the present invention provides a pump dispenser of the above-mentioned type wherein said media is a fiber or powder.

Another object of the present invention is to provide a pump dispenser of the above-mentioned type wherein the fiber or powder is a hair increasing material.

Yet another object is to provide a pump dispenser of the above mentioned type wherein the fiber or powder is suited to use for supplementing a locally hair-decreased area of the head of a person.

In order to achieve the above objects, the present invention provides a pump cap which comprises:

(1) an elastically deformable bulb that can be pressed downwardly; and (2) a dispenser having lower and upper ends wherein said dispenser comprises:

(a) at least one air intake tube [valve vent] for in taking air from the atmosphere;

(b) a valve cavity connecting the bulb to the valve vent;

(c) an air passageway with an upper and a lower end, wherein said lower end extends downward into a receptacle and directs air pressure into the receptacle and said upper end is in communication with the to the bulb, and (d) a dispensing member [product outlet] having an exit orifice through which product can flow outward.

The present invention also provides a pump cap which comprises:

(1) an elastically deformable bulb that can be pressed downwardly; and (2) a dispenser having lower and upper ends wherein said dispenser comprises:

(a) at least one air intake tube [valve vent] for in taking air from the atmosphere;

(b) a valve cavity connecting the bulb to the valve vent;

(c) an air passageway with an upper and a lower end, wherein said lower end extends downward into a receptacle and directs air pressure into the receptacle and said upper end is in communication with the to the bulb, (d) a one-way check valve mounted on the upper end of said air passageway providing reliable backflow prevention;

(e) a dispensing member [product outlet] having an exit orifice through which product can flow outward.

The present invention further provides a pump dispenser consisting of the pump cap of the present invention and a receptacle.

DETAILED DESCRIPTION OF THE PREFERRED EMBODIMENTS

Figure 1:
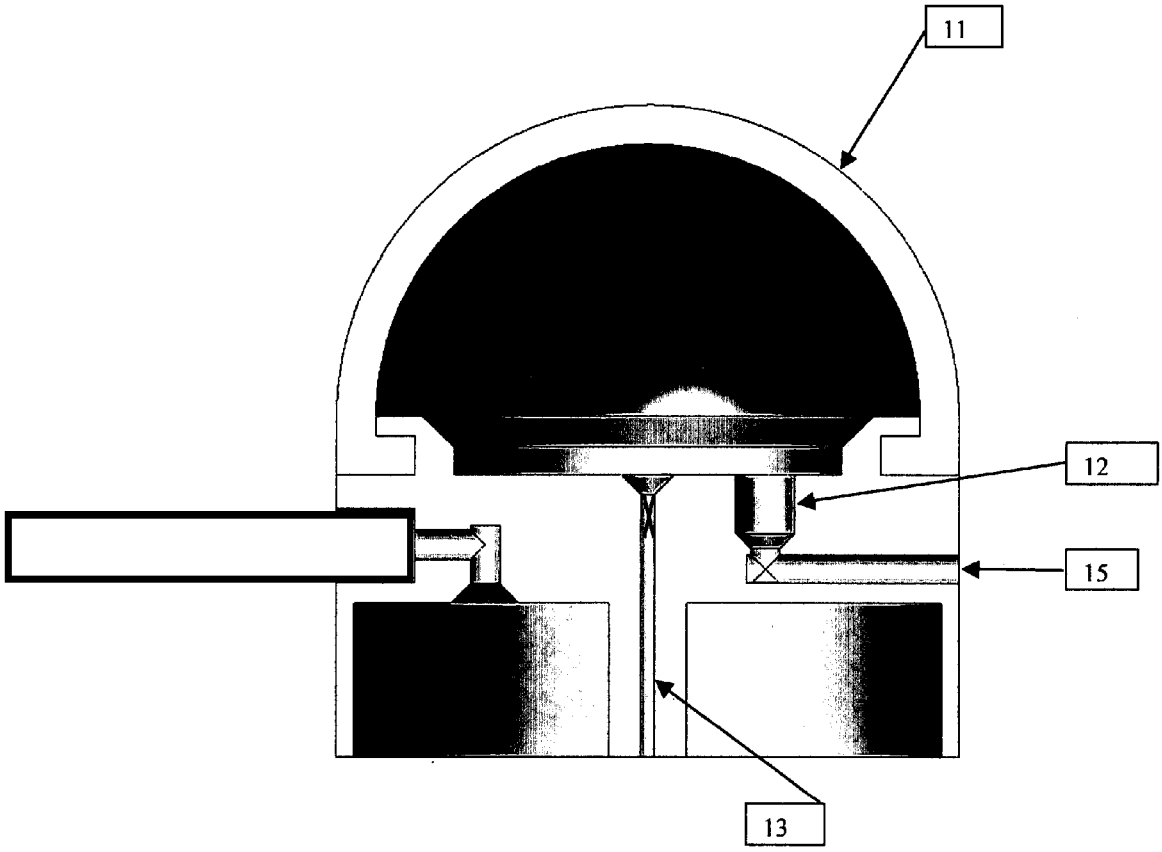
FIG. 1 is a side view, showing an embodiment of the present invention
Figure 2:
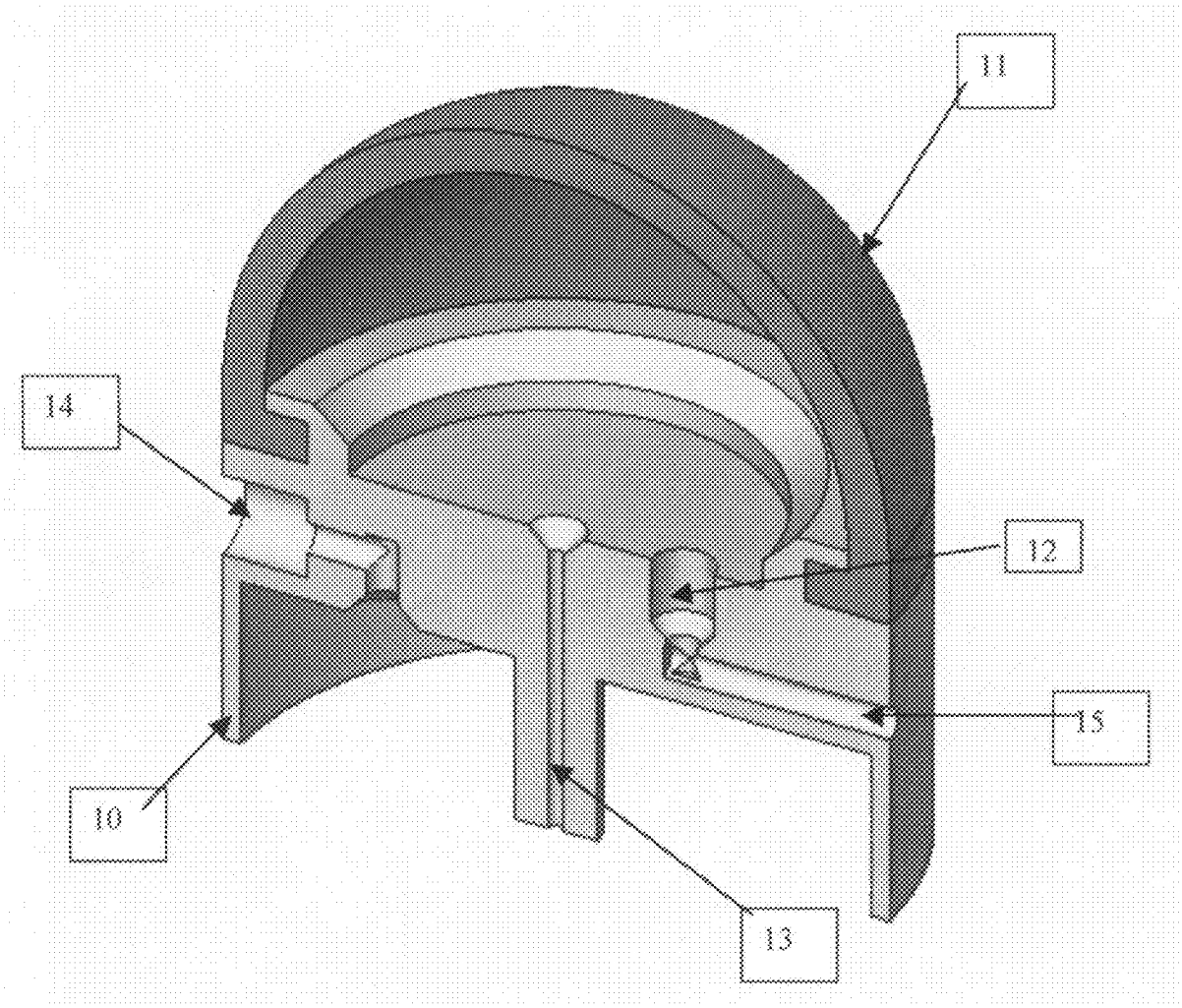
FIG. 2 is a cross sectional, side elevation view of an air atomizing spray gun constructed according to the teachings of the present invention.

The present invention provides an economical pump dispenser for dispersing a media, such as a powder or fiber and may be used to apply a cosmetic or personal care product. The pump dispenser of the present invention may be operated with one-hand and is suitable for dispersing a powder or fiber onto a scalp or other part of the body. The pump dispenser of the present invention further provides an improved dispersion of the media providing a discharge that can be accurately directed at objects.

The pump dispenser of the present invention consists of a pump cap which is suited to couple to a receptacle. The pump cap of the present invention comprises a bulb [11] and a dispenser. The dispenser consists of a valve cavity [12], a valve vent [15], an air passageway [13] and a product outlet [14]. The pump cap has an opening and is adapted to couple to a receptacle so as to seal the opening when the cap is coupled to the receptacle, said receptacle having an opening surrounded by a neck. Thus, the pump cap thereby provides a substantially airtight seal between the pump cap and the receptacle so as to contain the charge of pressurized air and the media within the interior chamber of the receptacle. The receptacle used in the present invention may be of the type including threads for threaded engagement with the threaded neck of the receptacle. The receptacle may be adapted to contain a quantity of a powder or fiber to be dispensed and is formed with side walls, a base and a neck portion.

The bulb [11] of the present invention has a wall composed of elastic material and positioned on the top in proximity to the dispenser so as to be operable by one hand. The elastomeric bulb has a central hollow body surrounding a resilient compressible interior air chamber which allows the bulb to be compressed when pressure is applied to the top. In one embodiment of the present invention, the bulb [11] has a dome shape. The bulb of the present invention is positioned over the upper end of the dispenser and is wedged into the dispenser through grooves that are located on the side of the upper end of the dispenser so as to provide an airtight seal between the dispenser and the bulb.

The upper end of the dispenser is connected to a one-directional air intake valve cavity [12]. The valve cavity [12] has in one end an opening in communication with the valve vent [15] and the other end in communication with the bulb [11]. The valve cavity [12] is structured and disposed to draw air into the compressible interior chamber of the bulb as the central hollow body is released from the compressed state and returned to a normally relaxed, full shape. Thus, when the bulb is released air from the atmosphere is drawn into the valve cavity [12] from the valve vent [15] and refills the bulb with air and the bulb thereby returns to its natural position upon the release of manual pressure. Thus, the bulb collects air and when pressed the bulb generates a blast of air into the air passageway [13] and when released the bulb returns to its natural position allowing for air to be drawn into the bulb's cavity. The valve cavity [12] automatically closes by means of a one-way valve to prevent air from exiting from the bulb.

The valve vent [15] is a one directional air intake tube having one end in communication with atmospheric air for taking air in from the atmosphere and the other end connected to the valve cavity [12]. To allow for a one-hand operation of the pump dispenser, the valve vent [15] is positioned on the side of the pump cap. The connection between the valve cavity [12] and the valve vent [15] is preferably at a 90 degree angle, which allows for more precision.

The air passageway [13] is in communication with the upper end of the dispenser. The air passageway [13] may for example contain a one-way check valve mounted on the upper end of said air passageway thereby providing reliable back-flow prevention and thus preventing air and fibers from entering said bulb. The air passageway [13], for example, may have a narrow passage which causes an increase in air pressure and directs the pressurized air into the receptacle. The air passageway, for example, may sit on top of the media. The product outlet [14] draws the media from the receptacle and disperses same through an outside opening. The product outlet [14] may optionally have a tube attached to the outside opening so as to make dispensing of the media more accurate.

Media in a form of powder or fiber used in the present invention include short fibers such as natural fibers, human hair, wool, cotton and silk or regenerated fiber thereof and synthetic fiber, cellulose fiber or carbon fiber such as nylon, vinylon and polyester. The color of the powder or fiber may be natural skin color, black or the like similar to human hair color or any other preferable color or which can be dyed such color. The average diameter and length of the media in a form of powder or fiber preferably is such that would easily fit through the product outlet. In order to make the length uniform a conventional cutting method such as a guillotine cutter, or a method of pulverizing with a pulverizer followed by sieving out may be applicable. However, making the length uniform is not essential to practice the present invention. Other powders such as talcum powder or baby powder, or any powders or fibers with different applications could also work appropriately In addition, the fibers may be entirely magnetized or magnetized over only a fraction of their length. The fibers may also include fibers having magnetic properties mixed with fibers that do not have magnetic properties (e.g., fibers that are filled with particles of a material for absorbing liquid (e.g., water), and/or particles suitable for swelling on contact with a liquid, and/or particles capable of dissolving on contact with the liquid).

For purpose of enhancing the scatter and separation property of the media, the media can be treated with a conventional separation accelerator in accordance with material nature thereof. Examples of the separation accelerator include inorganic salts such as sodium silicate, magnesium sulfate, sodium chloride, sodium sulfate and magnesium chloride; surfactants such as anionic surfactant, cationic surfactant and amphoteric surfactant; organic silicon compounds such as colloidal silica; and alminasol and the like.

The pump dispenser of the present invention is actuated by grasping in the palm of one hand and manually pressing with any finger or the hand down on the bulb at a pressure sufficient to release air into the air passageway. Thus, upon compressing the hollow body of the air passageway directs air from the bulb interior chamber into the receptacle. The pressurized air is thereby forced into the air passageway and into the receptacle containing fibers through the air passageway resulting in agitation of the media in the receptacle. The agitated material is lifted and dispersed throughout the bottle where it is forced out through a small opening in the product outlet that leads to the product outlet thereby depositing the media to the desired location, which is preferably inches away. Release of manual pressure on the bulb allows air to be drawn in to refill the bulb, thereby returning the bulb to its natural position so as to start the process again until sufficient media are deposited onto the desired location.

In one feature of the present invention a media in the form of powder or short fabrics can be sprayed with the use of a single hand to the area of the head where hair is locally decreased, continuously and in a stable manner.

While the invention has been described above with reference to specific embodiments thereof, it is apparent that many changes, modifications, and variations can be made without departing from the inventive concept disclosed herein, and such description is not intended as limitations on the scope thereof. Accordingly, it is intended to embrace all such changes, modifications, and variations that fall within the spirit and broad scope of the appended claims.

We claim:

1. A pump cap for dispensing a cosmetic media from a receptacle, the receptacle having a base and an outer upright peripheral wall extending from the base to define a receptacle chamber for the cosmetic media, the upright peripheral wall terminating in an open end, said pump cap comprising:

a closure including a top wall which terminates in a downward depending peripheral wall, said top wall having top and bottom sides, said closure receiving the open end of the receptacle adjacent said bottom side of said top wall of the closure and within the depending peripheral wall;

a deformable dome secured to said top wall of the closure to provide an air-tight dome chamber between said deformable dome and said top wall of said closure;

an air pump tube for providing airflow from said dome chamber to the open top end of the receptacle when said deformable dome is compressed, said air pump tube having a top end located in the dome chamber and a bottom end located in the receptacle chamber, said top end being flared out;

an air intake tube comprising a first air intake chamber running in a direction substantially parallel to the top wall of the closure and communicating with said peripheral wall of said closure, and a second air intake chamber communicating with said first air intake chamber and with said dome chamber, said second air inlet chamber being disposed perpendicularly to said first air inlet chamber, and being in communication with said first inlet chamber and said dome chamber, said air intake tube providing airflow from outside the dispenser to said dome chamber when deformable dome is released from a compressed to a non-compressed state; and an outlet chamber for dispensing cosmetic media from the receptacle, said outlet chamber communicating between a media outlet opening on the peripheral wall of said closure, and a receptacle chamber media opening located on the bottom side of the top wall of said closure, said receptacle chamber media opening being flush against the bottom side of the top wall of the closure;

such that the dispenser can be held in one hand and cosmetic media may be dispensed by successively compressing and releasing said deforming dome.

2. The pump cap of claim 1, said air pump tube including a one-way valve allowing air to flow from said dome chamber to said receptacle chamber but hindering air flow from said receptacle chamber into said dome chamber.

3. The pump cap of claim 1, further comprising a one-way air intake valve within said first air intake chamber, said one-way air intake valve allowing air to flow from outside the receptacle to within the dome chamber but hindering air flow in the opposite direction.

4. The dispenser of claim 1, wherein the air pump tube is positioned such that air expelled from said tube is incident on a top surface of the cosmetic media.

5. The dispenser of claim 1, further comprising:

a flange extending from and parallel to the top side of the closure;

wherein said deformable dome possesses a lip which fits under the flange, thereby sealing the deformable dome to the closure.

6. The dispenser of claim 1, wherein the air pump tube is located generally within the center of the closure.

7. An improved dispenser for cosmetic media, the dispenser comprising a receptacle and a pump cap, the receptacle having a base and an outer upright peripheral wall extending from the base to define a receptacle chamber for the cosmetic media, the pump cap comprising:

a closure including a top wall which terminates in a downward depending peripheral wall, said top wall having top and bottom sides, said closure receiving the open end of the receptacle adjacent said bottom side of said top wall of the closure and within the depending peripheral wall;

a flange extending from and parallel to the top side of the closure;

a deformable dome having a lip, said lip fitting under the flange of the closure, thereby providing an air-tight dome chamber between said deformable dome and said top wall of said closure;

an air pump tube for providing airflow from said dome chamber to the open top end of the receptacle when said deformable dome is compressed, said air pump tube being located generally in the center of said closure, said air pump tube having a valve located at a top end of said air pump tube, allowing air flow from said dome chamber to said receptacle chamber but hindering airflow in the opposite direction, said air pump tube having a top end located in the dome chamber and a bottom end located in the receptacle chamber, said top end being flared out, said bottom end extending only a small distance past the bottom side of the top wall of the closure, such that air expelled from said air pump tube into said receptacle chamber is directly incident on the cosmetic media in the receptacle chamber;

an air intake tube comprising a first air intake chamber running in a direction substantially parallel to the top wall of the closure and communicating with said peripheral wall of said closure, and a second air intake chamber communicating with said first air intake chamber and with said dome chamber, said second air intake chamber being disposed perpendicularly to said first air intake chamber, said air intake tube possessing a valve preventing air from flowing out of the dome chamber but allowing air to flow into the dome chamber, said air intake tube providing airflow from outside the dispenser to said dome chamber when the deformable dome is released from a compressed to a non-compressed state; and a media outlet chamber for dispensing media from the receptacle through the media outlet opening on the exterior of the pump cap, said media outlet chamber comprising a first cylindrical chamber communicating with a receptacle chamber media opening located on the bottom side of the top wall of the closure, said first cylindrical chamber being substantially perpendicular to said bottom side of said top wall of said closure, a second cylindrical chamber substantially perpendicular to said first cylindrical chamber, and communicating with said first cylindrical chamber, and a third cylindrical chamber parallel to and communicating with said second cylindrical chamber and with said media outlet opening on the exterior of the pump cap;

said media outlet chamber communicating between the media outlet opening, and a receptacle chamber media opening located on the bottom side of the top wall of said closure, said receptacle chamber media opening being flush against the bottom side of the top wall of the closure.

8. The dispenser of claim 7, wherein said media is a powder or fiber.

9. The dispenser of claim 8, wherein said fiber is a hair increasing material.

10. The dispenser of claim 8, which provides a discharge which can be accurately directed at the head or body or a person.

11. The dispenser of claim 8, wherein the media outlet opening has a tube attached to it so as to make dispensing of the media more accurate.

* * * * *